US011788501B1

(12) United States Patent
Woodward

(10) Patent No.: US 11,788,501 B1
(45) Date of Patent: Oct. 17, 2023

(54) SPARK PLUG ADAPTOR

(71) Applicant: Donald Woodward, Holbrook (AU)

(72) Inventor: Donald Woodward, Holbrook (AU)

(73) Assignee: Donald Woodward, Holbrook (AU)

( * ) Notice: Subject to any disclaimer, the term of this patent is extended or adjusted under 35 U.S.C. 154(b) by 0 days.

(21) Appl. No.: 17/899,154

(22) Filed: Aug. 30, 2022

(51) Int. Cl.
*F02P 15/00* (2006.01)

(52) U.S. Cl.
CPC ..... *F02P 15/00* (2013.01)

(58) Field of Classification Search
CPC ..... F02P 15/00
See application file for complete search history.

(56) References Cited

U.S. PATENT DOCUMENTS

2009/0306839 A1* 12/2009 Youngquist ..... G01K 7/021
73/114.26

* cited by examiner

*Primary Examiner* — Jacob M Amick
*Assistant Examiner* — Charles J Brauch
(74) *Attorney, Agent, or Firm* — Bochner PLLC; Andrew D. Bochner

(57) ABSTRACT

A spark plug adapter device for an internal combustion engine, comprising a first housing having a central bore configured to engage with an electrical harness at a proximal end and having an external thread formed at a distal end. The spark plug adapter device further comprising a second housing having a central bore and an internal thread provided at a proximal end thereof to mate with the external thread formed on the distal end of the first housing and an external thread formed at a distal end to facilitate mating with the internal combustion engine. Moreover, the first housing and the second housing may engage to define an internal space into which a spark plug is received, such that the first and second housings encapsulate the spark plug.

9 Claims, 3 Drawing Sheets

SPARK PLUG ADAPTOR

FIELD OF INVENTION

The present invention relates generally to internal combustion engines, and in particular, to an adaptor device for adapting spark plugs of varying dimensions to be used in a specific internal combustion engine arrangement.

BACKGROUND OF THE INVENTION

Spark plugs play an important role in controlling the combustion of fuel within the combustion chamber of internal combustion engines. By controlling when the spark is delivered to the air/fuel mixture present within the combustion chamber enables the power delivered by the engine to be harnessed.

Depending upon the application of the internal combustion engine, spark plugs come in a variety of different sizes. Due to the large number of automobiles in the market, conventional automotive engines have smaller, less expensive spark plugs that are widely available. In comparison, aeronautical engines are less common and the engines are configured to require spark plugs are generally larger and have larger threads and require greater electrical shielding. For such applications, the spark plugs must be shielded and weather proof to minimise interference with other electronic devices in the cockpit. By weather proofing the spark plug, electrical shorting of the inner spark plug electrode to the main body of the engine is minimised, which can have catastrophic outcomes if such shorting occurs at altitude.

As a result, replacement of spark plugs in aeronautical engines can be an expensive exercise as appropriately sized spark plugs must be sourced and fitted, generally requiring specialised tools and long lead times for delivery of components.

Thus, there is a need to provide an adaptor device that can adapt more commonly available spark plugs for use in such specialised situations.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

STATEMENT OF INVENTION

The invention according to one or more aspects is as defined in the independent claims. Some optional and/or preferred features of the invention are defined in the dependent claims.

Accordingly, in one aspect of the invention there is provided a spark plug adapter device for an internal combustion engine, comprising:

- a first housing having a central bore configured to engage with an electrical harness at a proximal end and having an external thread formed at a distal end;
- a second housing having a central bore and an internal thread provided at a proximal end thereof to mate with the external thread formed on the distal end is of the first housing and an external thread formed at a distal end to facilitate mating with the internal combustion engine;

- wherein the first housing and the second housing engage to define an internal space into which a spark plug is received, such that the first and second housings encapsulate the spark plug.

In one embodiment, the distal end of the second housing is open such that electrodes of the spark plug project beyond the distal end of the second housing.

The external thread formed on the distal end of the second housing may have a diameter of 18 mm with a 1.5 mm pitch to fasten to the internal combustion engine.

The central bore of the second housing may have an internal thread configured to mate with an external thread of the spark plug. The internal thread of the central bore of the second housing may have a diameter of 8 mm with 1 mm pitch or a diameter of 10 mm with 1 mm pitch.

The first housing may have a top external thread of ⅝-24 teeth per inch and/or ¾-20 teeth per inch, for high-tension electrical lead connection.

In one embodiment of the present invention, a terminal plug of the spark plug is removed prior to insertion into the internal space of the first housing and second housing.

In another embodiment of the present invention, the internal space comprises a nut member to engage with a terminal plug of the spark plug.

The first housing and the second housing may engage together using conventional tools.

The spark plug adaptor may be mounted and removed to/from the internal combustion engine using conventional tools, such as a standard aviation socket tool.

BRIEF DESCRIPTION OF THE DRAWINGS

The invention may be better understood from the following non-limiting description of preferred embodiments, in which.

DETAILED DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention.

The spark plug adapter device of the present invention will be described below in use with adapting a conventional automotive spark plug for use in aviation engines. In this regard, the spark plug adapter device will be described utilising an 18 mm by 1.5 mm pitch thread to connect to the engine; however, it will be appreciated that the spark plug adaptor device could use a variety of different pitch threads, such as threads of 12 mm and 14 mm with pitches of 1.25 mm and 1.5 mm, as will be appreciated by those skilled in the art.

Similarly, the spark plug adapter device of the present invention will primarily be configured to accept a spark plug that has a base thread of 8 mm with a 1 mm pitch. However, it will be appreciated that the spark plug adapter device may also be configured to receive a spark plug with a thread of 10 mm with 1 mm pitch and other similar dimensions as will be appreciated by those skilled in the art.

Figure 1:
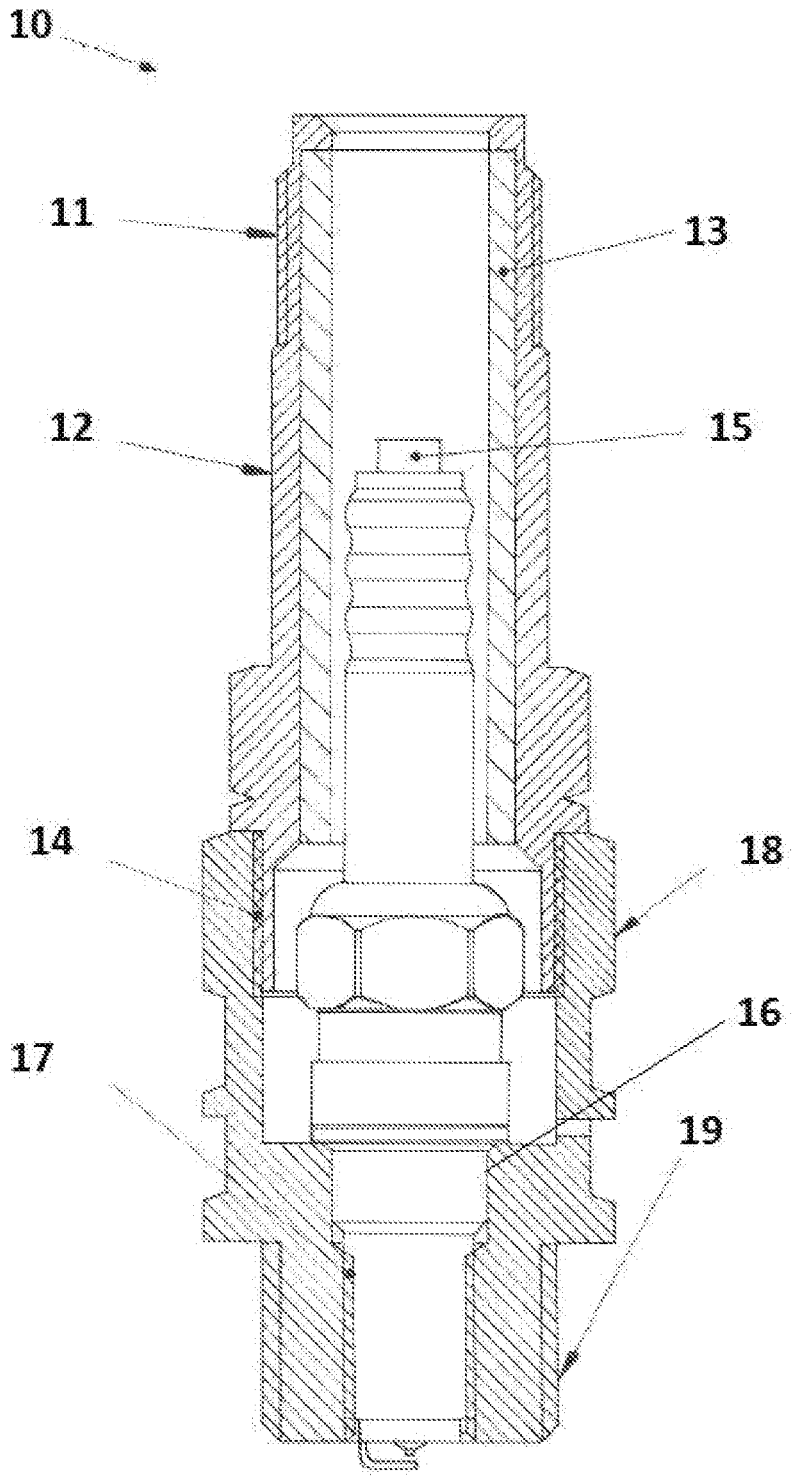
FIG. 1 is a cross-sectional side view of a spark plug adapter device with a small spark plug encapsulated inside.

Referring to FIG. 1, an embodiment of a spark plug adapter device 10 is shown in use with a conventional spark plug 15. The device 10 comprises two parts, a top housing 12 and a bottom housing 18, with the spark plug 15 captured within the space formed by the two housings 12, 18 in a sealed, weatherproof environment.

The top housing 12 has an external thread 11 formed adjacent an end thereof to facilitate connection to an electrical harness for supplying electrical energy to the device. The external thread 11 may utilize a one of two threads to perform the electrical shorting and weatherproofing, these threads may be ⅝-24 teeth per inch and/or ¾-20 teeth per inch. The inner wall 13 of the top housing 12 has an insulation lining to electrically insulate the spark plug 15 contained therein. The distal end of the top housing 12 has a threaded portion 14 to facilitate connection of the top housing 12 to the bottom housing 18, as shown. Such a threaded connection further enhances the weatherproof functionality of the device 10. It will be appreciated that the manner in which the top housing 12 and the bottom housing 18 connect may vary from a common thread connection. In this regard, the connection may be via a cam lock or other type of interference fit to achieve a secure and weather proof connection.

The lower housing 18 has an inner bore 16 extending therethrough, which is open at the bottom surface thereof to enable the ground and central electrode of the spark plug 15 to project therefrom, as shown. The internal surface of the distal end of the inner bore 16 has a connection thread 17 formed thereon to mate with the external thread provided on the end of the spark plug 15. This enables the spark plug 15 to be securely retained to the lower housing when in use.

To secure the device 10 to the engine, the outer surface of the distal end of the lower housing 18 has an outer thread 19 configured to mate with the thread of the engine, to which the adapter device 10 is to be used. The outer thread 19 facilitates connection to the internal combustion engine and may have one of many thread sizes, ranging from 12 mm to 20 mm.

Figure 2:
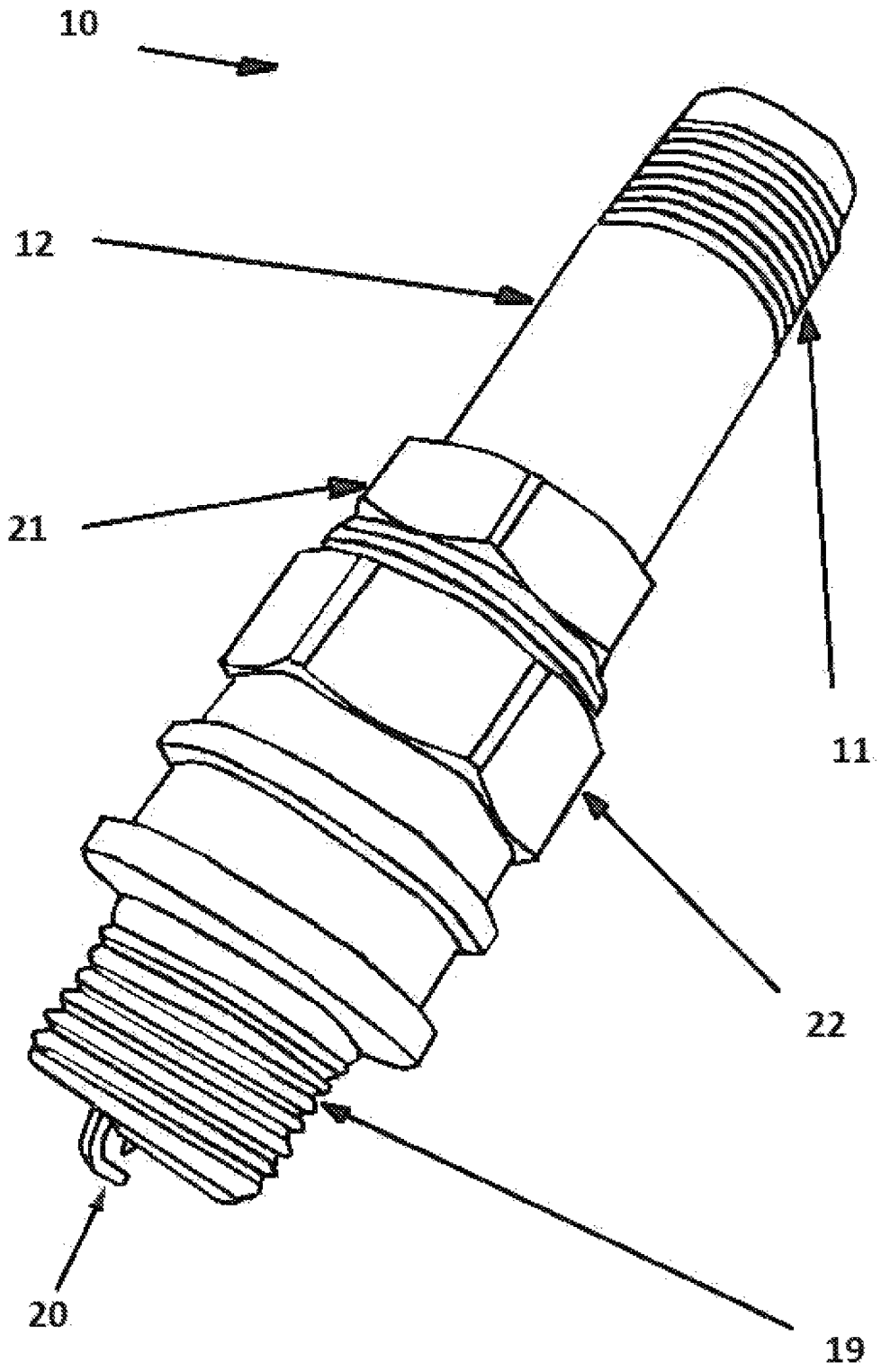
FIG. 2 is a perspective view of the spark plug adapter device of FIG. 1 with spark plug encapsulated inside.

Referring to FIG. 2, the device 10 is shown in perspective view. As is clearly shown, the distal outer end of the top housing 12 has a hexagon profile 21 to facilitate tightening of the top housing 12 to the bottom housing 18 through the use of a conventional tool. Similarly, the upper outer end of the bottom housing 18 also has a hexagon profile 22 to facilitate tightening of the device 10 to the engine via a conventional tool such that the electrodes 20 if the spark plug 15 contained within the device 10 extends into the combustion chamber of the engine.

Figure 3:
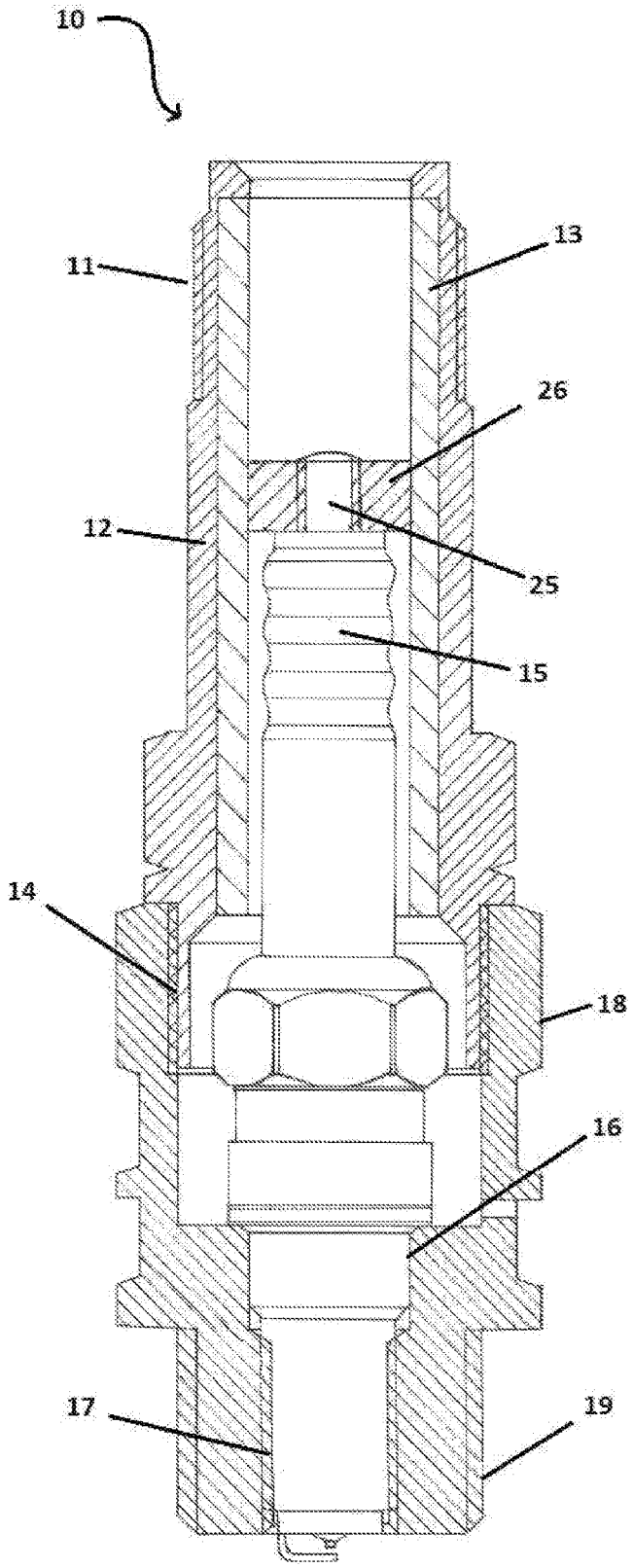
FIG. 3 is a cross sectional side view of the spark plug adapter device with a small spark plug encapsulated inside with top electrode nut.

In the embodiment as shown in FIG. 1, the spark plug 15 is a conventional spark plug with the terminal plug or head portion removed prior to fitting into the device 10. The terminal plug or head portion may be removed by a cutting disc or the like. As is shown in FIG. 3, in an alternative embodiment of the device 10, the terminal plug or head portion 25 of the spark plug 15 may remain such that the spark plug requires no pre-preparation for use with the device 10. In such an embodiment, a nut member 26 is provided within the top housing 12 to engage with the terminal plug 25 of the spark plug 15 to complete the electrical connection of the system.

It will be appreciated that the device 10 of the present invention can be readily adapted to receive a conventional spark plug that is encased within the top housing and the bottom housing of the device in a sealed and weather proof manner. As a result, the smaller spark plug 15 encased within the device 10 is able to function as a larger spark plug that is fully insulated and located in the correct position for ignition. The device 10 can be fitted using conventional tooling and can be readily adapted to accommodate a range of different thread pitches and sizes.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

It will be appreciated by those skilled in the art that many modifications and variations may be made to the methods of the invention described herein without departing from the spirit and scope of the invention.

The claims defining the invention are as follows:

1. A spark plug adapter device for an internal combustion engine, comprising:

a first housing having a central bore configured to engage with an electrical harness at a proximal end and having an external thread formed at a distal end;

a second housing having a central bore and an internal thread provided at a proximal end thereof to mate with the external thread formed on the distal end of the first housing and an external thread formed at a distal end to facilitate mating with the internal combustion engine;

wherein the first housing and the second housing engage to define an internal space into which a spark plug is received, such that the first and second housings encapsulate the spark plug; and wherein the distal end of the second housing is open such that electrodes of the spark plug project beyond the distal end of the second housing.

2. A spark plug adaptor device according to claim 1, wherein the external thread formed on the distal end of the second housing has a diameter of 18 mm with a 1.5 mm pitch to fasten to the internal combustion engine.

3. A spark plug adaptor device according to claim 1, wherein the central bore of the second housing has an internal thread configured to mate with an external thread of the spark plug.

4. A spark plug adaptor device according to claim 3, wherein the internal thread of the central bore of the second housing has a diameter of 8 mm with 1 mm pitch or a diameter of 10 mm with 1 mm pitch.

5. A spark plug adaptor according to claim 1, wherein a terminal plug of the spark plug is removed prior to insertion into the internal space of the first housing and second housing.

6. A spark plug adaptor according to claim 1, wherein the internal space comprises a nut member to engage with a terminal plug of the spark plug.

7. A spark plug adaptor according to claim 1, wherein the first housing and the second housing engage together using conventional tools.

8. A spark plug adaptor according to claim 1, wherein the spark plug adaptor is mounted to the internal combustion engine using conventional tools.

9. A spark plug adaptor according to claim 1, wherein the first housing has a top external thread of ⅝-24 teeth per inch and/or ¾-20 teeth per inch for high tension electrical lead connection.

* * * * *